US009156288B2

(12) United States Patent
Onodera

(10) Patent No.: US 9,156,288 B2
(45) Date of Patent: Oct. 13, 2015

(54) PRINTING DEVICE FOR CONTROLLING PRINT HEAD BASED ON OBLIQUE LINES ON PRINT MEDIUM

(71) Applicant: CASIO COMPUTER CO., LTD., Shibuya-ku, Tokyo (JP)

(72) Inventor: Yutaka Onodera, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/016,011

(22) Filed: Aug. 30, 2013

(65) Prior Publication Data

US 2014/0060432 A1 Mar. 6, 2014

(30) Foreign Application Priority Data

Sep. 5, 2012 (JP) ..... 2012-195053

(51) Int. Cl.

*B41J 11/46* (2006.01)
*B41J 29/38* (2006.01)
*B41J 15/04* (2006.01)

(Continued)

(52) U.S. Cl.

CPC ..... *B41J 11/46* (2013.01); *B41J 11/008* (2013.01); *B41J 15/04* (2013.01); *B41J 15/042* (2013.01); *B41J 29/38* (2013.01); *B65H 23/0216* (2013.01); *B41J 3/4075* (2013.01); *B65H 2301/4493* (2013.01); *B65H 2301/44324* (2013.01); *B65H 2511/12* (2013.01); *B65H 2511/242* (2013.01); *B65H 2513/10* (2013.01); *B65H 2553/41* (2013.01); *B65H 2553/51* (2013.01); *B65H 2701/124* (2013.01); *B65H 2701/1241* (2013.01); *B65H 2701/12411* (2013.01);

(Continued)

(58) Field of Classification Search

CPC ..... B41J 11/46; B41J 11/008; B65H 7/14; B65H 23/0216; B65H 2511/242

See application file for complete search history.

(56) References Cited

U.S. PATENT DOCUMENTS

| | | | | |
|---|---|---|---|---|
| 6,997,455 | B2 | 2/2006 | Romine | |
| 2010/0045759 | A1 * | 2/2010 | Wexler et al. | 347/96 |
| 2012/0001978 | A1 * | 1/2012 | Burke | 347/19 |
| 2012/0081715 | A1 | 4/2012 | Takano | |
| 2012/0306958 | A1 * | 12/2012 | Pawlik et al. | 347/19 |

FOREIGN PATENT DOCUMENTS

| | | | |
|---|---|---|---|
| CN | 1891488 | A | 1/2007 |
| EP | 1245399 | A2 | 10/2002 |

(Continued)

OTHER PUBLICATIONS

Japanese Office Action (and English translation thereof) dated Jun. 4, 2015, issued in counterpart Japanese Application No. 2012-195053.

(Continued)

*Primary Examiner* — Daniel J Colilla

(74) *Attorney, Agent, or Firm* — Holtz, Holtz, Goodman & Chick PC

(57) ABSTRACT

A printing device includes a print head configured to execute printing on one surface of a long-size medium to be printed, on the other surface of which a plurality of oblique lines of the same angle of obliquity are formed at regular intervals, a conveying section configured to convey the medium to be printed, a sensor configured to detect the oblique lines, and a control section configured to control the print head to execute printing while changing a position of printing on the medium to be printed in accordance with an interval between the oblique lines in a conveying direction of the medium to be printed detected by the sensor.

18 Claims, 7 Drawing Sheets

(51) Int. Cl.

| | |
|---|---|
| ***B65H 23/02*** | (2006.01) |
| ***B41J 11/00*** | (2006.01) |
| *B41J 3/407* | (2006.01) |

(52) U.S. Cl.
CPC ..... *B65H2801/12* (2013.01); *Y10T 428/1476* (2015.01); *Y10T 428/28* (2015.01)

(56) References Cited

FOREIGN PATENT DOCUMENTS

| | | | |
|---|---|---|---|
| JP | 60129261 | A | 7/1985 |
| JP | 9-109425 | A | 4/1997 |
| JP | 11091150 | A | 4/1999 |
| JP | 2000094732 | A | 4/2000 |
| JP | 2005053187 | A | 3/2005 |
| JP | 2008105347 | A | 5/2008 |
| JP | 2010115893 | A | 5/2010 |
| JP | 2012078545 | A | 4/2012 |
| WO | 0430911 | A1 | 4/2004 |

OTHER PUBLICATIONS

Chinese Office Action (and English translation thereof) dated May 28, 2015, issued in counterpart Chinese Application No. 201310397386.X.

* cited by examiner

PRINTING DEVICE FOR CONTROLLING PRINT HEAD BASED ON OBLIQUE LINES ON PRINT MEDIUM

CROSS-REFERENCE TO RELATED APPLICATIONS

This application is based upon and claims the benefit of priority from prior Japanese Patent Application No. 2012-195053, filed Sep. 5, 2012, the entire contents of which are incorporated herein by reference.

BACKGROUND OF THE INVENTION

1. Field of the Invention

The present invention relates to a printing device configured to execute printing on a long-size rolled medium to be printed.

2. Description of the Related Art

At present, there is a printing device configured to print a character string, picture such as an illustration or the like on a long-size medium to be printed such as a tape-like member or the like on the basis of character data, a picture such as an illustration or the like input from a keyboard or received from some other device to thereby create an arbitrary label.

Further, there is a printing device configured to execute printing on a long-size rolled medium to be printed. In, for example, Jpn. Pat. Appln. KOKAI Publication No. 9-109425, a method of printing a mark enabling detection of a center position of a tape on an edge part of the tape is disclosed and, in addition to this, a printing device capable of printing print data by executing accurate positioning coping with a deviation in a direction perpendicular to the conveying direction of the tape by a method of previously printing marks along the tape centerline is disclosed.

However, in the above-mentioned printing device, when marks are printed in advance before a wide original raw tape is cut into tapes of the desired width, determination of the tape width must be done in advance, and hence the cutting width of the original raw tape, cutting positions, and the like are determined correspondingly, thereby leaving no room for flexibility. Further, it takes a lot of trouble to provide marks at an edge part or a center of the tape after the original raw tape is cut into tapes of the desired width.

BRIEF SUMMARY OF THE INVENTION

Accordingly, it is an object of the invention to provide a printing device which makes it possible to execute printing while calculating a positional deviation in the conveying direction and correcting the printing position through simple control, and facilitates manufacture of media to be printed of various widths.

According to one aspect of the present invention, there is provided a printing device comprising: a print head configured to execute printing on a first surface of a medium to be printed, wherein a plurality of oblique lines of the same angle of obliquity are formed on a second surface of the medium to be printed at regular intervals; a conveying section configured to convey the medium to be printed; a sensor configured to detect the oblique lines; and a control section configured to control the print head to execute printing in such a way that a position of data to be printed on the medium is adjusted based on an interval which is detected by the sensor and which is between the oblique lines in a conveying direction of the medium to be printed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
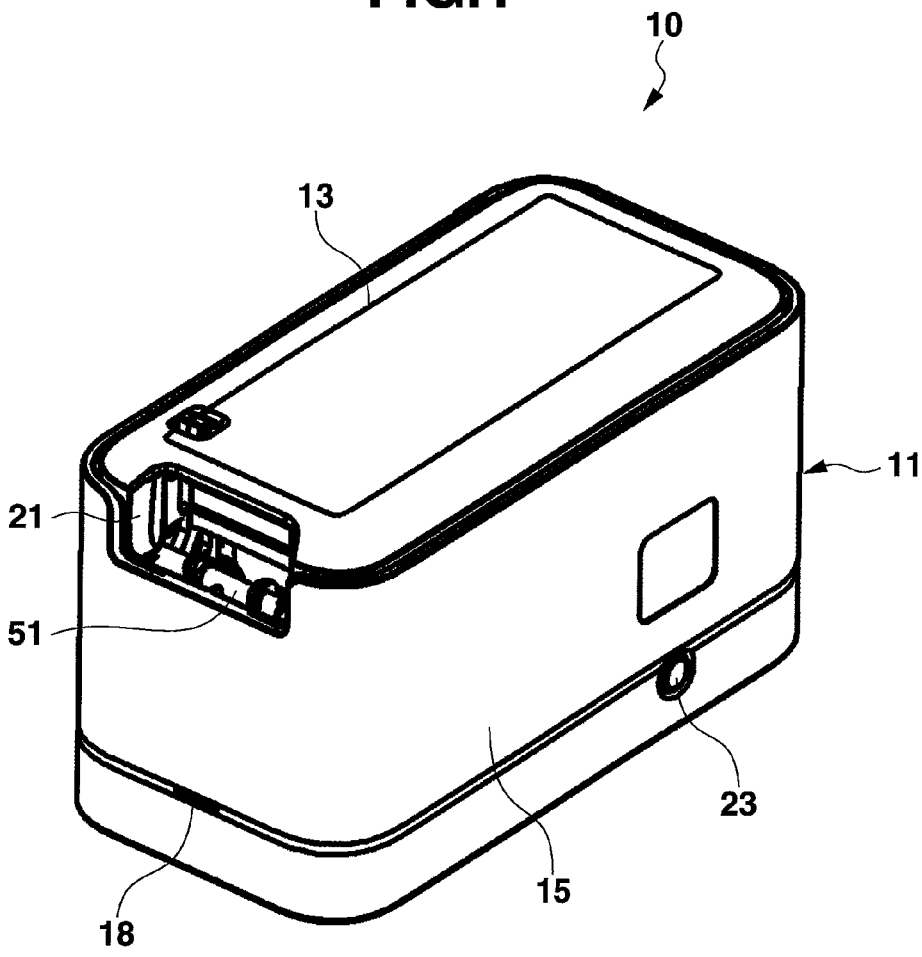
FIG. 1 is a perspective view showing an external appearance of a printing device according to the present invention.
Figure 2:
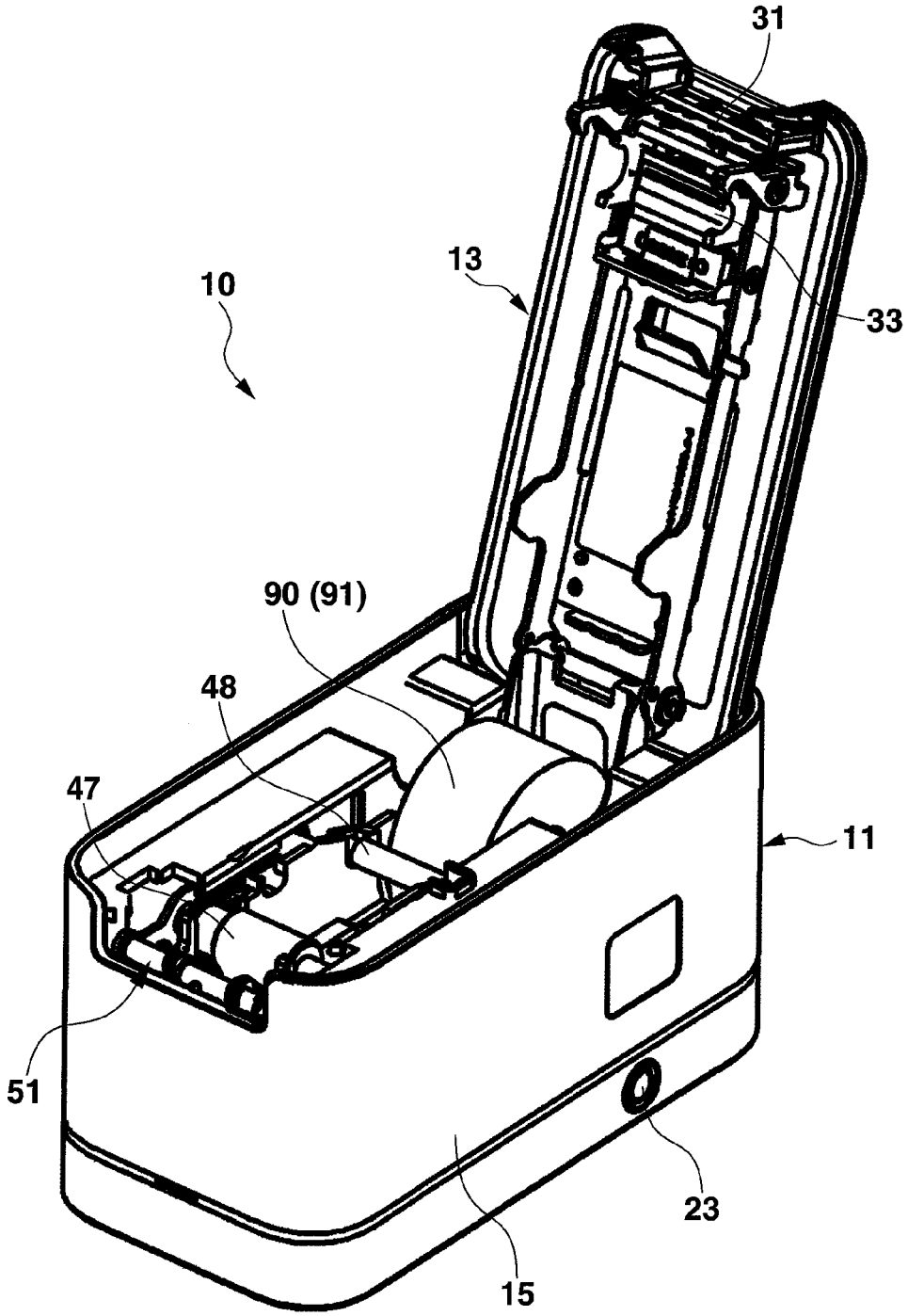
FIG. 2 is a perspective view showing a state of the printing device according to the present invention where a top cover thereof is opened.

Hereinafter, an embodiment of the present invention will be described with reference to the drawings. FIG. 1 is a perspective view showing an external appearance of a printing device according to the present invention. FIG. 2 is a perspective view showing a state of the printing device 10 according to the present invention where a top cover section 13 thereof is opened. It should be noted that in this embodiment, regarding the upside/downside in the printing device 10, the top cover section 13 side shown in FIG. 1 is defined as the upside, and the base side at which the device is placed is defined as the downside. Regarding the front/back, the ejection opening 21 side from which a long-size medium to be printed 91 such as a tape-like member is ejected is defined as the front side.

As shown in FIG. 1, the printing device 10 incorporates a printer unit 40 therein, i.e., in a housing constituted of a substantially rectangular-parallelepiped-like housing main body section 11, and top cover section 13 covering the upper part of the housing main body section 11.

Further, the printing device 10 includes an ejection opening 21 from which a long-size medium to be printed 91 such as a tape-like member, including release paper is ejected at a front end of the housing. On the medium to be printed 91, an image such as a character, illustration or the like is printed. The printing device 10 is provided with a printing mechanism inside the housing main body section 11, can house a tape roll 90 therein, includes a plug-in terminal 23 configured to receive print data such as a character string, image or the like from a personal computer (PC), image input device used to input characters, illustrations or the like used to create a label on the side surface of the housing main body section 11, and further includes a lamp 18 configured to blink at the time of data transmission/reception at a position below the ejection opening 21.

Figure 3:
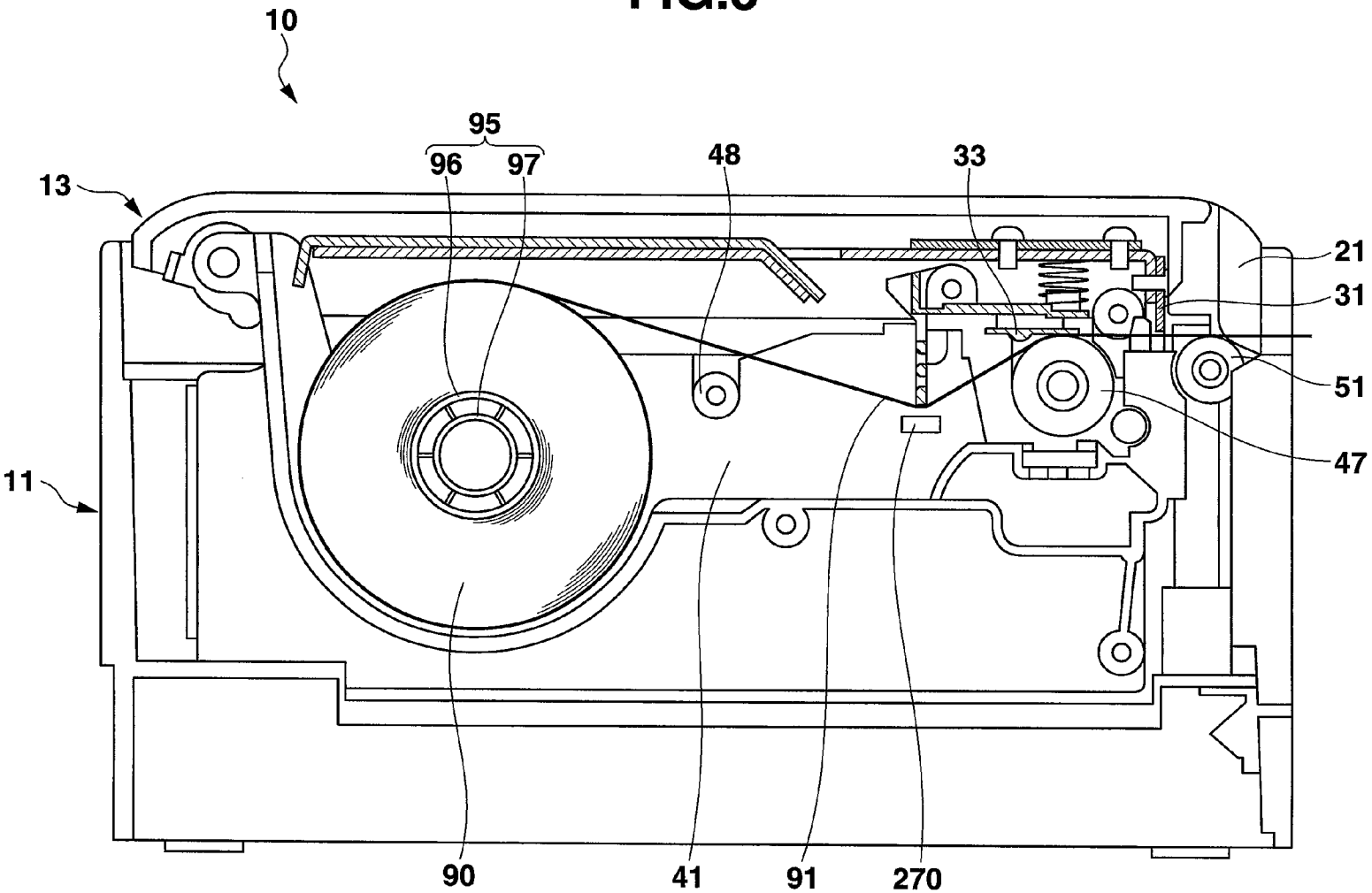
FIG. 3 is a schematic cross-sectional view showing the internal structure of the printing device according to the present invention.

As shown in FIG. 2, and FIG. 3, the printing device 10 includes a print head 33 such as a thermal head or the like, and cutter 31 inside and near the distal end of the top cover part 13, and is configured to cut the medium to be printed 91 ejected from the ejection opening 21 shown in FIG. 1 at the position of the ejection opening 21 by means of the cutter 31 functioning as a tape-cutting mechanism.

Further, as shown in FIG. 3, the printing device 10 of the present invention is configured to detect a deviation direction, and angle of deviation in the conveying direction by reading a plurality of oblique lines of the same angle of obliquity printed at regular intervals, and parallel to each other on the other side, i.e., on the backside of the release paper of the medium to be printed 91 by means of a sensor 270 constituted of a photosensor, photodiode, charge coupled device (CCD) image sensor which is one of solid-state imaging elements, and is a semiconductor element, complementary metal oxide semiconductor (CMOS) image sensor which is a solid-state imaging element employing a complementary metal oxide semiconductor or the like, and arranged at a position on the conveying path of the medium to be printed 91 before a conveying roller 47, and execute printing such that the printing is made coincident with the middle position of the medium to be printed 91, and predetermined upper/lower blank spaces or right/left blank spaces are obtained by correcting, for example, the printing position on the medium to be printed 91.

Further, the conveying roller 47 is provided at a position of the housing main body section 11 opposed to a position of the print head 33 provided inside the top cover part 13 of the printing device 10, the print head 33 and conveying roller 47 constitute a printing mechanism, and printing of an image such as a character, symbol, pattern, illustration picture or the like is executed by the print head 33 while the medium to be printed 91 held between the print head 33 and conveying roller 47 is sent forth by the conveying roller 47.

Figure 4:
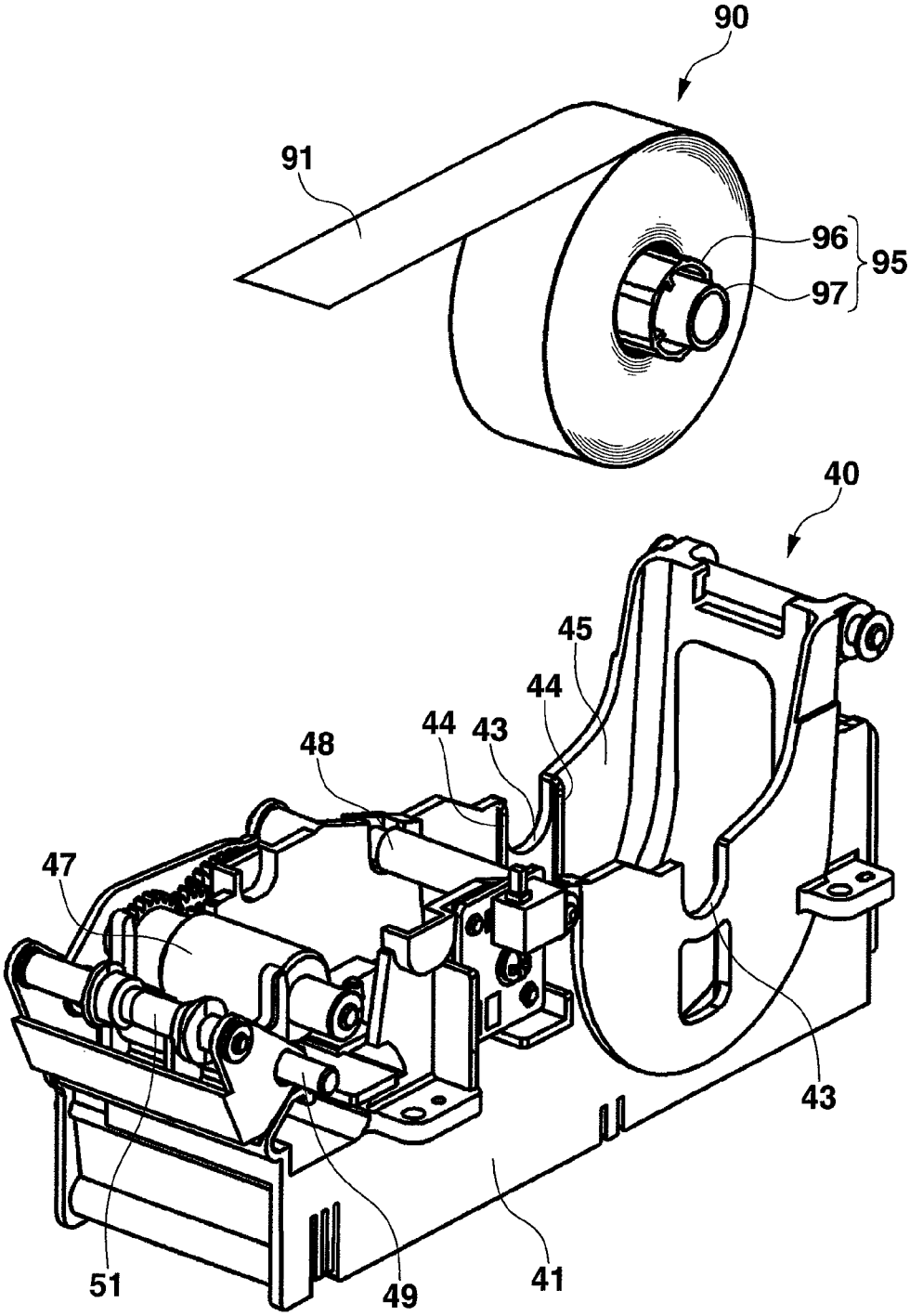
FIG. 4 is a perspective view showing the internal structure of the printing device according to the present invention.

This conveying roller 47 is provided in the printer unit 40 housed in the housing main body section 11, the printer unit 40 is, as shown in FIG. 4, provided with a roll guide slot 43 configured to receive a shaft section 97 of the tape roll 90 in each of right and left side plates of a chassis 41, is provided with the conveying roller 47, and an auxiliary roller 48 between the right and left side plates, and is further provided with a drive mechanism for the rollers 47 and 48 such that the mechanism is fixed to the chassis 41.

The printer unit 40 uses the chassis 41 made of metallic plates, forms a roll tape storage section 45, includes the conveying roller 47, auxiliary roller 48 configured to rotate in tandem with the conveying roller 47, and a guide roller 51 and the like configured to restrict the deviation of the medium to be printed 91 in the lateral direction, and arranged at a position near the ejection opening 21, and further includes a drive section, and control section to be described later, and configured to control the drive section and printing mechanism.

It should be noted that the conveying roller 47, auxiliary roller 48, and guide roller 51 each include rotating shafts such that the shafts are parallel to each other, and extend in the lateral direction, and the center of each roller in the lateral direction is made coincident with the center of the print head 33 so that the center of each roller can be made coincident with the conveying reference axis direction which is the criterion of the conveying direction, whereby the centerline of the medium to be printed 91 is aligned with the conveying reference axis direction.

Further, the roll tape storage section 45 is formed on the inner side of the printer unit 40, the upwardly opened U-shaped roll guide slots 43 are formed in the right and left side plates, both ends of the shaft section 97 of a tape former 95 are supported with the roll guide slots 43, guide ribs 44 are provided on the inner side of each side plate at positions near the roll guide slot 43, and both ends of a main body section 96 of the tape former 95 are brought into contact with the guide ribs 44, whereby the position of the tape roll 90 is determined. It should be noted that the roll tape storage section 45 is provided with a roll tape detection section constituted of a photosensor which makes it possible to detect the tape width or the like of the tape roll 90 by detecting the color of the wall of the inner bottom section of the main body section 96 of the tape roll 90 or a distance between the sensor and the wall.

Further, the auxiliary roller 48 is configured to, when the medium to be printed 91 such as the tape-like member including the release paper, and wound around the tape former 95 is drawn out from the tape roll 90, draw out the medium to be printed 91 wound into a roll in cooperation with the conveying roller 47 such that appropriate tension is applied to the medium to be printed 91 drawn out from the tape roll 90 without the entrance angle of the medium to be printed 91 at the conveying roller 47 being largely changed even if the diameter of the tape roll 90 has become small after use of the medium to be printed 91.

The medium to be printed 91 on which an image or the like is to be printed includes release paper on the other side thereof. On the other side of the release paper, oblique lines having the predetermined angle of obliquity with respect to the conveying direction of the medium to be printed 91 coinciding with the centerline of the medium to be printed 91 are printed parallel to each other at regular intervals between both ends of the medium to be printed 91 in the longitudinal direction across the full width thereof, and the medium to be printed 91 is wound around the main body section 96 of the tape former 95.

Figure 5:
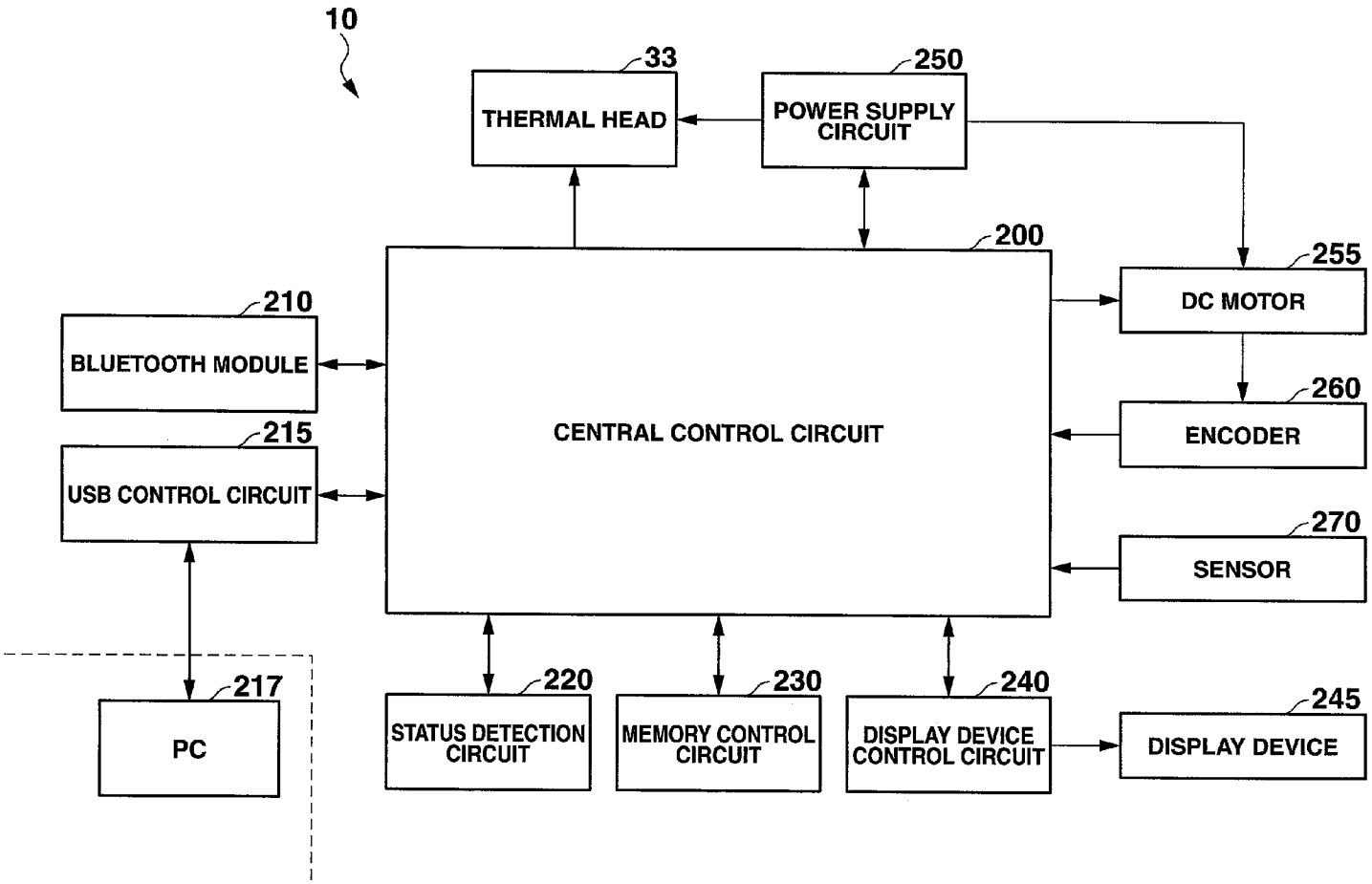
FIG. 5 is a system configuration view including another device (PC) from which print data of the printing device according to the present invention is transmitted.

Next, the system configuration of the printing device 10 will be described below by using the drawing. FIG. 5 is a system configuration view of the printing device 10 according to the present invention.

The system configuration of the printing device 10 is formed by connecting a personal computer (PC) 217 serving as a host terminal, and the printing device 10 connected to an AC adaptor to each other through a USB control circuit 215 based on a USB interface. Further, in some cases, the system configuration is formed by connecting the printing device 10 by wireless to a host terminal such as a PC or the like through a Bluetooth (registered trade name) module 210.

As shown in FIG. 5, the printing device 10 is provided with a central control circuit 200 constituted of a CPU serving as a control section. Further, to the central control circuit 200, a memory control circuit 230 configured to control a memory such as a ROM storing therein a program, RAM serving as a work area, or the like, is connected.

Further, the central control circuit 200 includes a timer function and clock function, and is configured to execute count of a pulse time and measurement of an interval time by means of these functions.

Further, to the central control circuit 200, a status detection circuit 220 configured to execute detection of an open lever linked to opening/closing of the top cover section 13 in association with loading of the medium to be printed 91 executed by the user, and execute detection of the type of loaded medium to be printed 91 by means of the aforementioned roll tape detection section, is connected.

Further, to the central control circuit 200, a display device control circuit 240 configured to cause the lamp 18 (LED) shown in FIG. 1 serving as a display device 245 used to indicate that communication with the host is being executed or indicate an error display to light up and blink, is connected.

Furthermore, the central control circuit 200 is configured to control a power supply circuit 250 constituting the main power supply of each of the print head 33 and DC motor 255, and directly control on/off drive of the print head 33 serving as the printing mechanism, and DC motor 255 which is a conveying motor, and serves as the drive section.

Further, to the central control circuit 200, an encoder 260 coupled to the motor drive system, and photosensor configured to measure pulses generated from the encoder 260 which are used when the rotational speed of the DC motor 255 configured to convey the medium to be printed 91 is to be finely speed-controlled, are connected, and the central control circuit 200 performs, for example, PWM control and the like.

The central control circuit 200 realizes a standard printing speed matched to the printing device 10 in order to execute pretty printing within a short time in accordance with the throughput of the CPU, specification output of the print head 33, type of medium to be printed 91, and the like.

Further, the central control circuit 200 can monitor the conveying amount of the medium to be printed 91 by counting the number of pulses generated from the encoder 260 when a predetermined amount of the medium to be printed 91 is to be conveyed.

Further, to the central control circuit 200, the sensor 270 is connected in order to monitor a deviation of the medium to be printed 91 to be conveyed in the specified direction.

In the manner described above, the central control circuit 200 executes printing on the medium to be printed 91 by controlling the print head 33 serving as the printing mechanism in accordance with information on the print data transmitted from the PC or the like while performing control of the DC motor 255 conveying the medium to be printed 91 at a predetermined speed.

Next, regarding a method of executing printing at a regular position on the medium to be printed 91 such as a tape-like member or the like by detecting a deviation direction, and angle of deviation in the conveying direction of the medium to be printed 91 in the printing device 10 of the present invention, control coping with a deviation of the medium to be printed 91, and deviation in the conveying direction of the printing device 10, will be described below by using the drawings.

Figure 6:
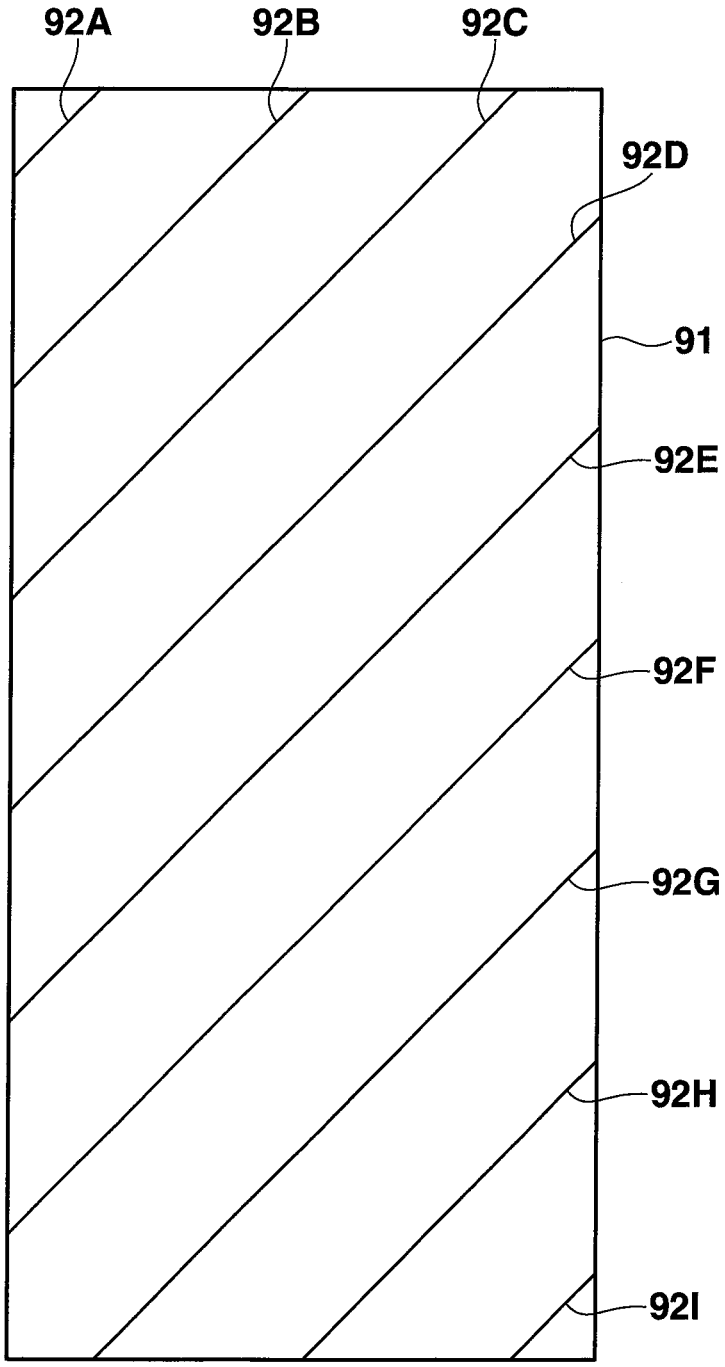
FIG. 6 is an explanatory view associated with a long-size medium to be printed which is used for the printing device according to the present invention, and on which a plurality of oblique lines are formed at regular intervals.

As described previously, the medium to be printed 91 on which characters and the like are to be printed includes release paper on the other side thereof and, as shown in FIG. 6, on the other side of the release paper, a plurality of oblique lines 92 (92A, 92B, 92C, 92D, 92E, 92F, 92G, 92H, 92I, . . . ) of the same angle of obliquity are printed in advance at regular intervals, and parallel to each other across the full width of the medium to be printed 91.

It should be noted that on the medium to be printed 91, the plurality of oblique lines 92 (92A, 92B, 92C, 92D, 92E, 92F, 92G, 92H, 92I, . . . ) of the same angle of obliquity are printed at regular intervals, and parallel to each other between both ends of the medium to be printed 91 in the longitudinal direction, whereby it is also possible to print in advance oblique lines on an original raw rolled tape with release paper, and having a width of, for example, ten inches, cut the printed original raw tape in the width direction into small-width tapes to thereby create one two-inch-wide rolled tape, one three-inch-wide rolled tape, and one five-inch-wide rolled tape. In this case, oblique lines are printed in advance on the raw rolled tape, and hence it is possible to freely set the tape width, and cut out tapes from the raw rolled tape.

Further, it is possible for the central control circuit 200 serving as the control section of the printing device 10 to detect that when the conveying reference axis direction deviates to the right with respect to the tape longitudinal axis direction centerline, the intervals between oblique lines become smaller, and when the conveying reference axis direction deviates to the left with respect to the tape longitudinal axis direction centerline, the intervals between oblique lines become larger by measuring the arrival time between adjacent oblique lines while conveying the medium to be printed 91 at a fixed speed.

Figure 7:
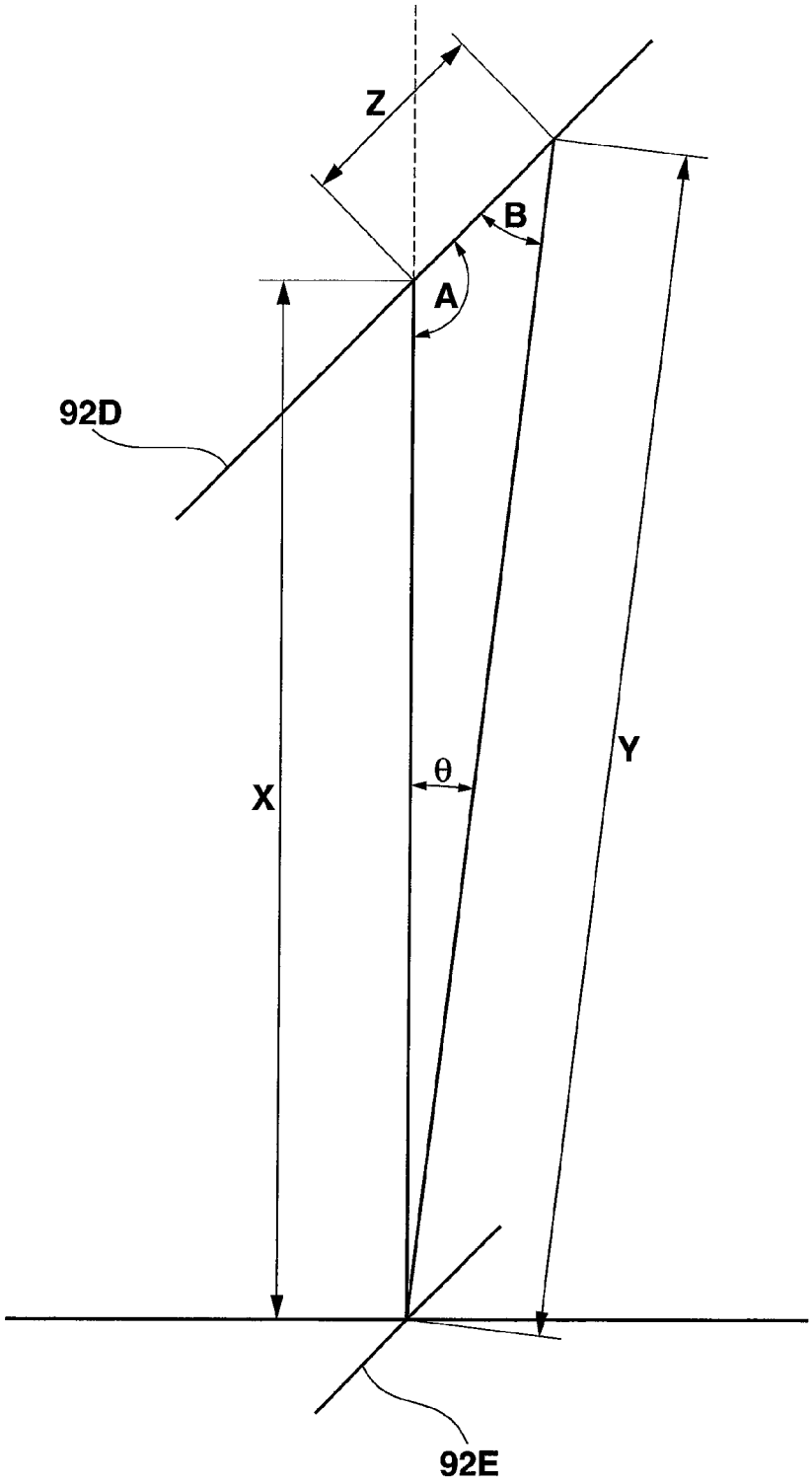
FIG. 7 is an explanatory view associated with calculation of an angle of deviation in the conveying direction of the printing device according to the present invention.

That is, the central control circuit 200 measures the arrival time between the oblique line 92D and oblique line 92E adjacent to each other to derive the detected oblique line interval Y while conveying the medium to be printed 91 with respect to the regular oblique line interval X between the oblique line 92D and oblique line 92E adjacent to each other exemplified in FIG. 7, whereby it is possible for the central control circuit 200 to determine to which of the right and left the conveying reference axis direction deviates with respect to the tape longitudinal axis direction centerline.

Further, the central control circuit 200 can derive an angle of deviation A from the derived oblique line interval Y.

More specifically, according to the sine theorem associated with the lengths of three sides of a triangle based on the following three sides including the predetermined oblique line interval X (preset value), oblique interval Y (measured value) regarded as being longer than the predetermined length from the deviation in the conveying direction, and amount of change Z resulting from the deviation of the conveying reference axis direction, angle of deviation θ in the conveying direction, predetermined oblique line angle A (preset value), and angle B formed between Y and Z, equation (1) is obtained as follows.

$$Y/\sin A = Z/\sin\theta = X/\sin B \quad (1)$$

Further, according to the cosine theorem, equation (2) is obtained as follows.

$$Z^2 = X^2 + Y^2 - 2\cdot X\cdot Y\cdot\cos\theta \quad (2)$$

Further, equation (3) is derived from the simultaneous equations of equation (1) and equation (2) as follows.

$$Y^2\cdot(\sin\theta)^2/(\sin A)^2 = X^2 + Y^2 - 2\cdot X\cdot Y\cdot\cos\theta \quad (3)$$

The angle of deviation θ in the conveying direction can be calculated on the basis of the preset value X, measured value Y, and value of the angle A.

Further, in this way, the control section can calculate the lateral deviation between predetermined oblique lines by detecting a deviation direction perpendicular to the conveying reference axis direction, and angle of deviation θ, and on the basis of the angle of deviation θ, and calculate an amount of deviation from the center by an integral of the lateral deviations. The control section controls the print head 33 to change the print range to a predetermined position in a direction perpendicular (orthogonal) to the conveying reference axis direction of the medium to be printed 91.

It should be noted that the control section is not limited to the case where when an angle of deviation associated with the conveying reference axis direction, and direction of deviation, and amount of deviation of the center of the medium to be printed 91 in the width direction from the center of the head length of the print head 33 in the width direction are detected, the print range is changed for correction. For example, when the control section is to change the position of printing on the medium to be printed 91 on the basis of a deviation amount, the control section may make fine adjustments to the conveying reference axis direction of the medium to be printed 91 so that the conveying reference axis direction can be corrected to the predetermined position by making the conveying roller 47 have right/left rotational pressure values different from each other in order to correct the deviation in the direction perpendicular (orthogonal) to the conveying reference axis direction.

Further, there is flexibility in sensing point, and hence it is possible to facilitate assembly of the device without the need for accuracy in arrangement of the sensor 270.

As described above, according to this example, it is possible to provide a printing device 10 configured to execute printing while calculating a positional deviation in a direction perpendicular to the conveying reference axis direction by simple control and correcting the printing position, and a medium to be printed 91 which can be easily manufactured even when the width thereof has to be changed.

Further, according to this example, on the medium to be printed 91, oblique lines of the same angle of obliquity are printed at regular intervals across the full width in the lateral direction perpendicular to the conveying reference axis direction of the medium to be printed 91, and hence it is possible to detect a deviation in the conveying reference axis direction without restricting the position for sensing in the conveying reference axis direction.

Furthermore, according to this example, when the printing position on the medium to be printed 91 is to be changed on the basis of a deviation amount, it is possible to create an appropriately printed label by changing the conveying reference axis direction to correct a deviation in a direction perpendicular to the conveying reference axis direction.

Further, according to this example, the medium to be printed 91 is formed by printing thereon a plurality of oblique lines 92 (92A, 92B, 92C, 92D, 92E, 92F, 92G, 92H, 92I, . . . ) of the same angle of obliquity at regular intervals, and parallel to each other between both ends of the medium to be printed 91 in the longitudinal direction, whereby it is possible to freely manufacture small-width rolled tapes from an original raw rolled tape with release paper. It should be noted that although in this example, an example in which the tape-like member with release paper is used as the medium to be printed 91 has been described, the example is not limited to this. More specifically, the configuration in which the release paper is not provided, and a low-tack adhesive is applied to the entire surface on the opposite side of the printing surface of the medium to be printed 91 may also be employed. In this case, on the surface on the opposite side of the printing surface of the medium to be printed 91, the surface being coated with the low-tack adhesive, a plurality of oblique lines 92 (92A, 92B, 92C, 92D, 92E, 92F, 92G, 92H, 92I, . . . ) of the same angle of obliquity are printed at regular intervals, and parallel to each other between both ends of the medium to be printed 91 in the longitudinal direction, thereby forming the medium to be printed 91. Accordingly, it is possible to freely manufacture small-width rolled media to be printed 91 from an original raw rolled tape without release paper.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

Having described and illustrated the principles of this application by reference to one preferred embodiment, it should be apparent that the preferred embodiment may be modified in arrangement and detail without departing from the principles disclosed herein and that it is intended that the application be construed as including all such modifications and variations insofar as they come within the spirit and scope of the subject matter disclosed herein.

What is claimed is:

1. A printing device comprising:

a print head configured to execute printing on a first surface of a medium to be printed, wherein a plurality of oblique lines of the same angle of obliquity are formed on a second surface of the medium to be printed at regular intervals;

a conveying section configured to convey the medium to be printed;

a sensor configured to detect the oblique lines; and a control section configured to control the print head to execute printing in such a way that a position of data to be printed on the medium is adjusted based on an interval which is detected by the sensor and which is between the oblique lines in a conveying direction of the medium to be printed.

2. The printing device according to claim 1, wherein the control section measures an arrival time between predetermined oblique lines adjacent to each other to detect a distance between the oblique lines in the conveying direction of the medium to be printed, and measures a deviation direction and an angle of deviation in a direction perpendicular to a conveying reference axis direction which becomes a criterion of the conveying direction, thereby calculating a deviation amount, and the control section controls the print head to execute printing in such a way that the position of data to be printed on the medium is adjusted based on the deviation amount.

3. The printing device according to claim 2, wherein the oblique lines are formed on the medium to be printed across a full width of the medium to be printed, wherein the full width is a length measured in a direction perpendicular to the conveying direction of the medium to be printed.

4. The printing device according to claim 2, wherein when the position of data to be printed on the medium is adjusted based on the deviation amount, the control section shifts a drive range of the print head.

5. The printing device according to claim 4, wherein the medium to be printed comprises:

a printing tape, wherein printing is to be executed by the print head on a first surface of the printing tape, and release paper having a first surface and a second surface, wherein the first surface of the release paper is temporarily attached to a second surface of the printing tape, and the second surface of the release paper has the oblique lines formed thereon.

6. The printing device according to claim 4, wherein the second surface of the medium to be printed is coated with an adhesive.

7. The printing device according to claim 2, wherein when the position of data to be printed on the medium is adjusted based on the deviation amount, the control section moves the print head arranged at a position along the conveying reference axis direction of the medium to be printed, from said position to a predetermined position in a direction substantially perpendicular to the conveying reference axis direction.

8. The printing device according to claim 7, wherein the medium to be printed comprises:

a printing tape, wherein printing is to be executed by the print head on a first surface of the printing tape, and release paper having a first surface and a second surface, wherein the first surface of the release paper is temporarily attached to a second surface of the printing tape, and the second surface of the release paper has the oblique lines formed thereon.

9. The printing device according to claim 7, wherein the second surface of the medium to be printed is coated with an adhesive.

10. The printing device according to claim 2, wherein the medium to be printed comprises:

a printing tape, wherein printing is to be executed by the print head on a first surface of the printing tape, and release paper having a first surface and a second surface, wherein the first surface of the release paper is temporarily attached to a second surface of the printing tape, and the second surface of the release paper has the oblique lines formed thereon.

11. The printing device according to claim 2, wherein the second surface of the medium to be printed is coated with an adhesive.

12. The printing device according to claim 1, wherein the oblique lines are formed on the medium to be printed across a full width of the medium to be printed, wherein the full width is a length measured in a direction perpendicular to the conveying direction of the medium to be printed.

13. The printing device according to claim 12, wherein the position of data to be printed on the medium is adjusted based on a deviation amount, and the control section shifts a drive range of the print head.

14. The printing device according to claim 12, wherein the position of data to be printed on the medium is adjusted based on a deviation amount, and the control section moves the print head arranged at a position along a conveying reference axis direction of the medium to be printed, from said position to a predetermined position in a direction substantially perpendicular to the conveying reference axis direction.

15. The printing device according to claim 12, wherein the medium to be printed comprises:

a printing tape, wherein printing is to be executed by the print head on a first surface of the printing tape, and release paper having a first surface and a second surface, wherein the first surface of the release paper is temporarily attached to a second surface of the printing tape, and the second surface of the release paper has the oblique lines formed thereon.

16. The printing device according to claim 12, wherein the second surface of the medium to be printed is coated with an adhesive.

17. The printing device according to claim 1, wherein the medium to be printed comprises:

a printing tape, wherein printing is to be executed by the print head on a first surface of the printing tape, and release paper having a first surface and a second surface, wherein the first surface of the release paper is temporarily attached to a second surface of the printing tape, and the second surface of the release paper has the oblique lines formed thereon.

18. The printing device according to claim 1, wherein the second surface of the medium to be printed is coated with an adhesive.

* * * * *